US008245640B1

(12) United States Patent
Sutherland et al.

(10) Patent No.: US 8,245,640 B1
(45) Date of Patent: Aug. 21, 2012

(54) MELTED METAL DISPERSAL WARHEAD

(75) Inventors: Gerrit T. Sutherland, White Plains, MD (US); Phillip J. Miller, Issue, MD (US); Harold W. Sandusky, Fulton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/454,487

(22) Filed: May 12, 2009

Related U.S. Application Data

(62) Division of application No. 11/151,187, filed on May 27, 2005, now Pat. No. 7,584,702, which is a division of application No. 10/609,865, filed on Jul. 1, 2003, now Pat. No. 7,059,250.

(51) Int. Cl.
*F42C 19/12* (2006.01)

(52) U.S. Cl. ..... 102/205; 102/363

(58) Field of Classification Search ..... 102/205, 102/357, 363
See application file for complete search history.

(56) References Cited

U.S. PATENT DOCUMENTS

| | | | | |
|---|---|---|---|---|
| 2,417,437 | A | 3/1947 | Nicholas | |
| 2,953,443 | A | 9/1960 | Roger | |
| 2,969,638 | A * | 1/1961 | Sammons | 60/219 |
| 3,175,492 | A | 3/1965 | Charrin et al. | |
| 3,496,867 | A | 2/1970 | MacDonald | |
| 3,685,453 | A | 8/1972 | Hamrick | |
| 3,730,093 | A | 5/1973 | Cummings | |
| 3,865,035 | A * | 2/1975 | Munson et al. | 102/364 |
| 4,216,721 | A | 8/1980 | Marziano et al. | |
| 4,372,213 | A | 2/1983 | Rozner et al. | |
| 4,463,680 | A | 8/1984 | Sayles | |
| 5,052,272 | A * | 10/1991 | Lee | 89/7 |
| 5,866,840 | A * | 2/1999 | Briere et al. | 102/336 |
| 6,308,607 | B1 * | 10/2001 | Woodall et al. | 89/1.13 |
| 6,354,220 | B1 | 3/2002 | Graham et al. | |

* cited by examiner

*Primary Examiner* — Stephen M Johnson
(74) *Attorney, Agent, or Firm* — Fredric J. Zimmerman

(57) ABSTRACT

Molten droplets of a metal fuel, such as aluminum, are dispersed into air or water for a reaction releasing energy for military or other purposes. In one warhead embodiment, a cylinder of solid metal is disposed within a ceramic heat insulator; heaters of thermite-like material are embedded in the metal; and an explosive dispersing charge is disposed around or at one end of the cylinder. On activation, the heaters are ignited to melt the metal, and the charge then detonated to disperse droplets of the molten metal. In a related embodiment, the metal and heaters are within a containment having an atomizing nozzle at one end and, oppositely of the metal from the nozzle, a piston and gas generator. When the metal is melted, the gas generator is activated to expel molten metal droplets from the nozzle. The fuel may be pressed particles heated below the melting point and then dispersed by a charge providing enough heat to melt the particles; may be a single component, fuel-rich thermite compound; and may include droplet surface tension reducing additives. Advantages are that the weight and volume of a warhead do not include explosives, binders, and underwater-use oxidizers employed with fuel particles in conventional energetic materials. A warhead may thus have greater density for effective penetration; and, since the fuel is not incorporated in an explosive, dispersing charges can be removed until use, and metal fuels hazardous when incorporated in an explosive can be used.

3 Claims, 2 Drawing Sheets

40
42
43
44
46
47
50
52
54
56

40
42
43
44
46
47
56
60
61
62
62
65

MELTED METAL DISPERSAL WARHEAD

The present application is a divisional application of U.S. patent application Ser. No. 11/151,187, filed on May 27, 2005, now U.S. Pat. No. 7,584,702 B1; which is a divisional application of U.S. patent application Ser. No. 10/609,865, filed on Jul. 1, 2003, now U.S. Pat. No. 7,059,250 B1 as issued on Jun. 13, 2006.

BACKGROUND OF THE INVENTION (1) Field of the Invention

The present invention relates to ordnance, to explosives, and to thermic compositions and charges. The invention particularly relates to explosives where a fuel reacts with oxygen from standard environmental conditions, such as air or water, without ignition by a catalyst, pyrophoric material, or other fuel. The invention also relates to devices in which a material is heated within a container from which molten reactive particles are dispersed by an explosive or expulsion from a nozzle.

(2) Description of the Related Art

It is well-known to incorporate a metal fuel, such as aluminum, in energetic materials where, typically, particles of the fuel, when oxidized, provide a portion of the energy produced by the materials.

Heretofore however, in using such a metal fuel, it is mixed in particulate form, or otherwise combined, with an explosive, additional fuel, oxidizing and/or other materials. Examples are detonating substances such as HMX or RDX and substantially inert binders. For underwater use, such a metal fuel is, typically, provided with an oxidizer such as ammonium perchlorate, and a detonating substances with a substantial amount of oxidizer such as PBXN-111 or PBXN-103 are used.

These materials other than the metal fuel are disadvantageous to the extent that they take up a substantial part of the bulk and weight of a warhead or the like. Further, these materials are of relatively low density and strength and thus disadvantageous in a penetrating warhead.

When such a metal fuel is mixed with its dispersing and igniting explosive or other reactive material, the metal and material are limited to those that do not interact in storage or otherwise present a safety hazard. Also, such a mixed arrangement is undesirable since a dispersing charge cannot be removed from a warhead or other device to make it substantially inert.

It is known to disperse materials into an air or water environment for subsequent ignition and/or detonation as shown by the following seven United States patents:

U.S. Pat. No. 3,496,867 issued 24 Feb. 1970 to McDonald for "thermal radiation weapons" and discloses that combustible dusts and gaseous fuels have been mixed with air and detonated. Aluminum, magnesium, boron, boron carbide, zinc, and zirconium are mentioned as fuels, and these fuels are used with "a liquid combustible fuel" including pyrophoric substances to provide continuous ignition.

U.S. Pat. No. 3,685,453, which issued 22 Aug. 1972 to Hamrick for an "antipersonnel mine destruct system", discloses pressurization, by gas from a gas generator, of "highly explosive gases" expelled from a nozzle for subsequent detonation by a high explosive charge.

U.S. Pat. No. 3,730,093 issued 1 May 1973 to Cummings for "explosive apparatus" and shows a fuel surrounded by high explosive whose implosion expels the fuel radially into a fuel-air cloud. Proposed solid fuels are materials, such as napthelene, "decomposable into detonable molecules". The apparatus has a central tube filled with a mixture which undergoes a "thermit" reaction and is also dispersed by the detonation of the explosive into the dispersed fuel for ignition of the fuel-air cloud to overcome problems with timing such ignition after dispersion of the fuel has commenced.

U.S. Pat. No. 4,372,213, issued 8 Feb. 1983 to Rozner et al. for a "molten metal-liquid explosive method" and discloses a pyrotechnic pellet and igniter therefor within a casing, which may be aluminum placed in water. The pyrotechnic material may be composed of nickel, aluminum, and copper oxide powders. The pyrotechnic material melts the casing so that molten metals from the pellet and casing contact the water and cause an "energetic vapor or steam explosion". It is stated that, although the cause of such explosions is unknown, they would provide "moderate sized high energy explosive devices." A spatially inverse arrangement is also disclosed and has, from outside to inside, such pyrotechnic material, aluminum metal, and water.

U.S. Pat. No. 4,463,680 issued 7 Aug. 1984 to Sayles for a "method of generating single-event, unconfined fuel-air detonation" achieved by "simultaneous dispersion of both fuel and [an] initiating chemical catalyst into the atmosphere" where the fuel may be a "volatile liquid . . . aluminum, boron, or mixtures thereof". However, the metal is intended to be always used in such liquid. An explosive disperses ferrocenyl catalyst into diesel fuel and disperses both into the atmosphere for "explosive detonation of the fuel-air mixture".

U.S. Pat. No. 5,866,840 issued 2 Feb. 1999 to Briere et al. for "nozzles for pyrophoric IR decoy flares", and discloses the expulsion of pyrophoric liquids, specifically akyl aluminum compounds which burn with desirable IR emissions, from nozzles by a piston driven by gas from a gas generator.

U.S. Pat. No. 6,354,220 issued 12 Mar. 2002 to Graham et al. and discloses an "underwater explosive device" utilizing an explosive loaded with a metal such as titanium, magnesium or aluminum. It is stated that water can be an oxidizer for fuel-rich products of detonation, but does not give optimum results, a deficiency overcome by the provision of high pressure oxygen around the explosive.

SUMMARY OF THE INVENTION

In a melted metal dispersal warhead or other device incorporating the principles of the present invention for military or other purposes, molten droplets of a reactive metal fuel, such as aluminum, are dispersed into air or water to undergo an energy-releasing reaction therewith out the use of further ignition means, such as a catalyst, pyrophoric material, or other fuel dispersed into or with the droplets.

In accordance with the invention, the metal is heated, as by a thermite-like reaction, and subsequently dispersed by an explosive or by expulsion from a nozzle by gas pressure.

In one warhead embodiment of the invention, a cylinder of solid metal is disposed within a ceramic heat insulator; heaters of thermite-like material are embedded in the metal; and a dispersing charge of explosive is arranged around or at one end of the cylinder. On activation, the heaters are ignited to melt the metal, and the charge is then detonated to disperse droplets of the molten metal.

In a related embodiment, the metal and heaters are within a containment having an atomizing nozzle at one end and, oppositely of the metal from the nozzle, a piston and gas generator. On activation, the metal is melted as described above, and the gas generator is then activated to expel molten metal droplets from the nozzle.

In the practice of the invention, the fuel may provided as pressed particles heated to near, but below, the melting point and then dispersed by a charge providing enough heat to melt the particles. Also, the fuel may be incorporated in a single component, fuel-rich thermite compound; and may include droplet surface tension reducing additives.

It is an object of the present invention to provide ordnance or other devices wherein energy is released by a reactive metal with minimal amounts of explosives, oxidizers, and other substances.

A further object is to provide such devices for use in the atmosphere and underwater, so that fuel is oxidized in the air or water without ignition means such as a catalyst, pyrophoric material, or other fuel dispersed into or with the metal.

Another object is to provide such a device wherein the energy releasing materials have relatively high density and strength.

Yet another object is to provide such device where the reactive metal is not in contact with other reactive materials so that the metal need not be compatible therewith and so that any dispersing explosive element may be removed for safety in storage and handling.

Additional objects are to provide such energetic devices which have the foregoing advantages and are fully effective for their intended use.

BRIEF DESCRIPTION OF THE DRAWINGS

These and other objects, advantages, and novel features of the present invention will be apparent from the following detailed description when considered with the accompanying drawings wherein.

DETAILED DESCRIPTION OF THE INVENTION

Figure 1:
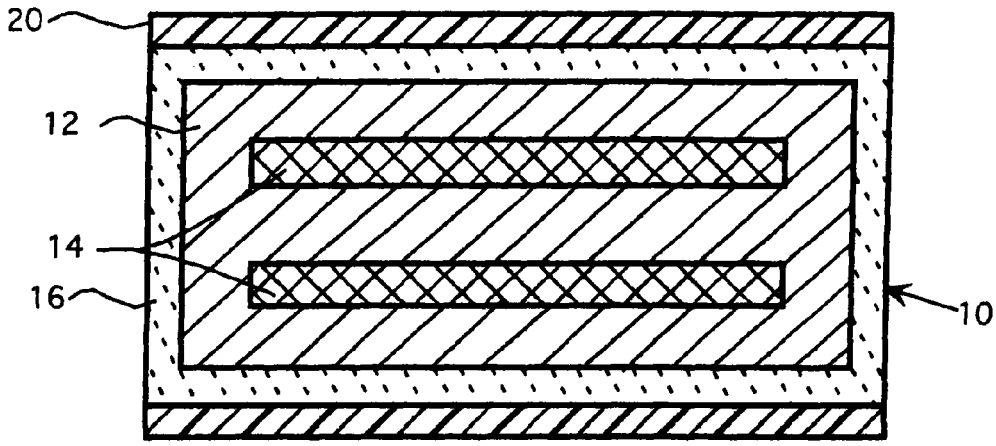
FIG. 1 is a conceptual sectional view of a first embodiment of a molten metal dispersal warhead embodying the present invention, the warhead being depicted before actuation and having heaters embedded in a solid reactive metal.

Referring more particularly to the drawings, FIG. 1 shows a melted metal dispersal warhead 10 which is constructed in accordance with the principles of the present invention and is a first embodiment thereof.

As with other embodiments, the warhead is an ordnance device for dispersing molten droplets of a reactive metal fuel into a fluid environment of the warhead so that the metal fuel undergoes an energy releasing, explosive, exothermic reaction with the fluid which is, typically, selected to be the natural atmosphere or a natural body of water such as the ocean. The invention is characterized by this reaction initiating upon such dispersion by reaction of the metal with a substance, such as oxygen or water, in the selected environment without the use of any catalyst, any pyrophoric material, or any reactive or oxidizable material other than the molten reactive metal itself. That is, only such molten droplets are dispersed into the fluid environment to initiate the energy releasing, explosive, exothermic reaction.

Warhead 10 is shown in FIG. 1 before actuation and, in this condition, has a quantity of solid reactive metal 12, preferably substantially pure aluminum and typically of cylindrical configuration, in which is embedded any suitable heaters 14 which are activated to melt the metal. It is apparent that the heaters heat the metal at least to its melting point and thus into a range of temperature including the melting point of the metal. For this purpose, the heaters may be materials which are be ignited in any suitable manner to undergo a thermite reaction effective to melt the metal 12 in a relatively short time. For the purposes of the present application, a "thermite reaction" is a reaction between a metal oxide and a reactive metal such as the well-known reaction between powdered iron oxide and powdered aluminum metal.

Figure 2:
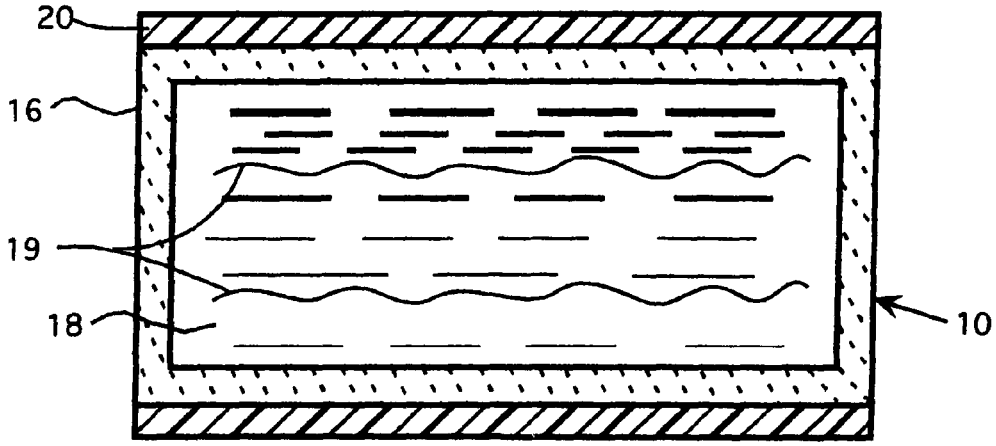
FIG. 2 is view similar to FIG. 1 showing the warhead after actuation with the metal melted but not yet dispersed by an explosive charge.

The solid reactive metal 12 is disposed in a container 16 which is preferably constructed of any suitable ceramic insulating material so that this material is disposed for thermal insulation of the metal during heating by heaters 14 and retains the metal after melting as seen in FIG. 2 where the molten metal is indicated by numeral 18 and the residue of the heaters is suggested by lines 19.

In warhead 10, container 16 is surrounded exteriorly and circumferentially with a layer of any suitable explosive material 20 which is thus juxtapositioned to reactive metal 12 to rupture the container and to disperse the molten metal 18 as molten droplets into the environment when material 20 is detonated. Such explosive material may be disposed otherwise than circumferentially of a cylinder of the reactive material to vary the distribution of the dispersed droplets.

Figure 3:
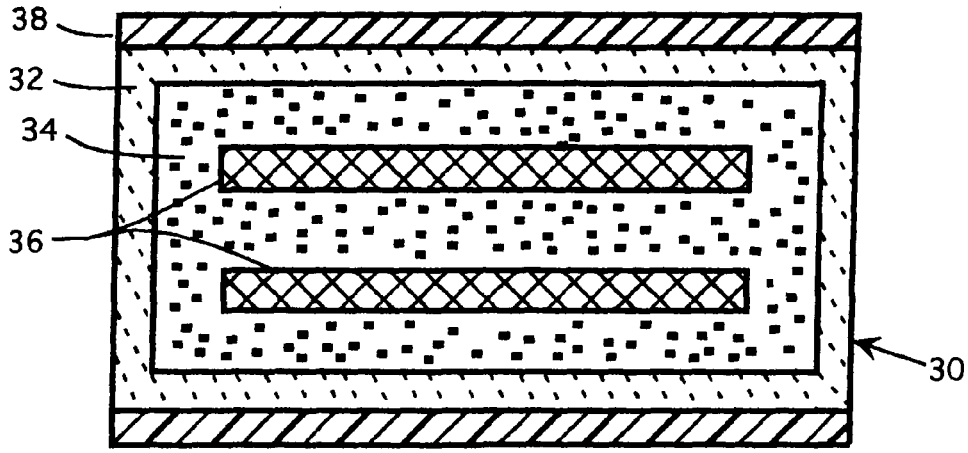
FIG. 3 is a view similar to FIG. 1, but showing a somewhat different embodiment with the metal in compressed, particulate form.

FIG. 3 shows a warhead 30 which is a second embodiment of the present invention and is similar to warhead 10 in having a container 32 of ceramic insulating material. Within this container before activation of warhead 30 there is disposed a reactive metal 34 in compressed, particulate form having thermite-reaction heaters 36 embedded therein. Exteriorly of the container 16 is disposed any suitable explosive material 38. In this second embodiment, the heaters bring the reactive metal to a temperature somewhat below its melting point, and the explosive material is selected so as to raise the temperature of the reactive metal at least to its melting point when the explosive material is detonated, as with warhead 10, to rupture the container and to disperse the molten metal as molten droplets into the environment when the explosive material 20 is detonated.

It will be apparent that other embodiments of the present invention having the reactive metal in particulate form are possible. For one such embodiment, the particulate metal may be heated completely to melting before dispersal as in the embodiment of FIGS. 1 and 2.

In another such embodiment, the reactive metal in particulate form may be mixed with thermite reaction heating material rather than having this material in discrete heaters as shown in FIGS. 1 and 3. When the reactive metal is so mixed, it may be brought to melting before dispersal as with the embodiment of FIGS. 1 and 2, or its melting may be completed by the explosive dispersal charge as with the embodiment of FIG. 3.

It is apparent that, in the above-described warhead embodiments of the present invention, materials providing a thermite reaction are placed in a container with a reactive metal; an explosive material is placed adjacent to the container; the thermite reaction materials are ignited to heat the reactive metal so that, when the warhead with the metal is placed in a fluid environment and the explosive material is exploded after heating the reactive metal by a thermite reaction, molten droplets of the reactive metal are formed and dispersed into the fluid environment to cause an explosive reaction between the reactive metal and any suitable substance in such environment, the reaction initiating forthwith upon dispersion of the molten droplets without the assistance of a catalyst, pyrophoric material, or reactive or oxidizing material other than the reactive metal.

Figure 4:
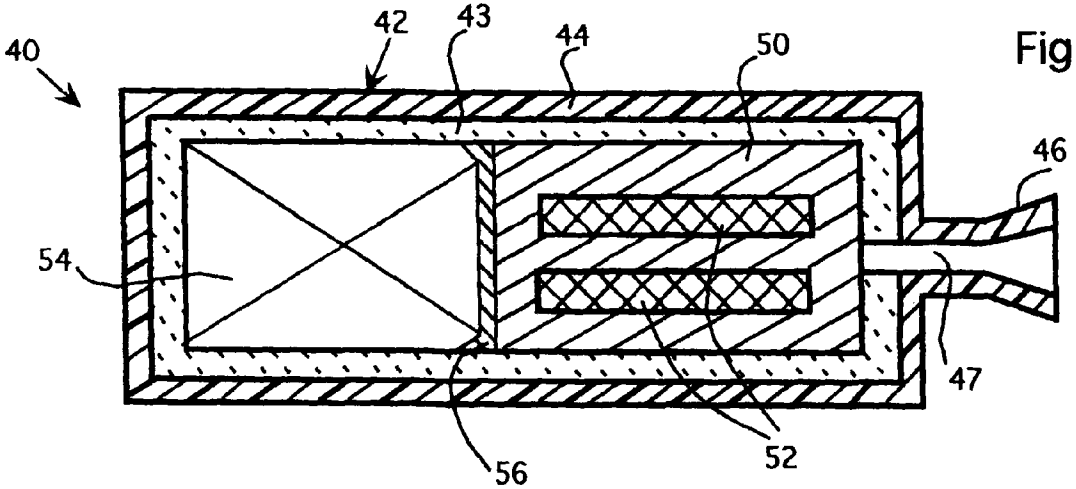
FIG. 4 is s a view similar to FIG. 1, but showing a different embodiment of the invention where molten metal is to be dispersed through a nozzle by gas pressure.
Figure 5:
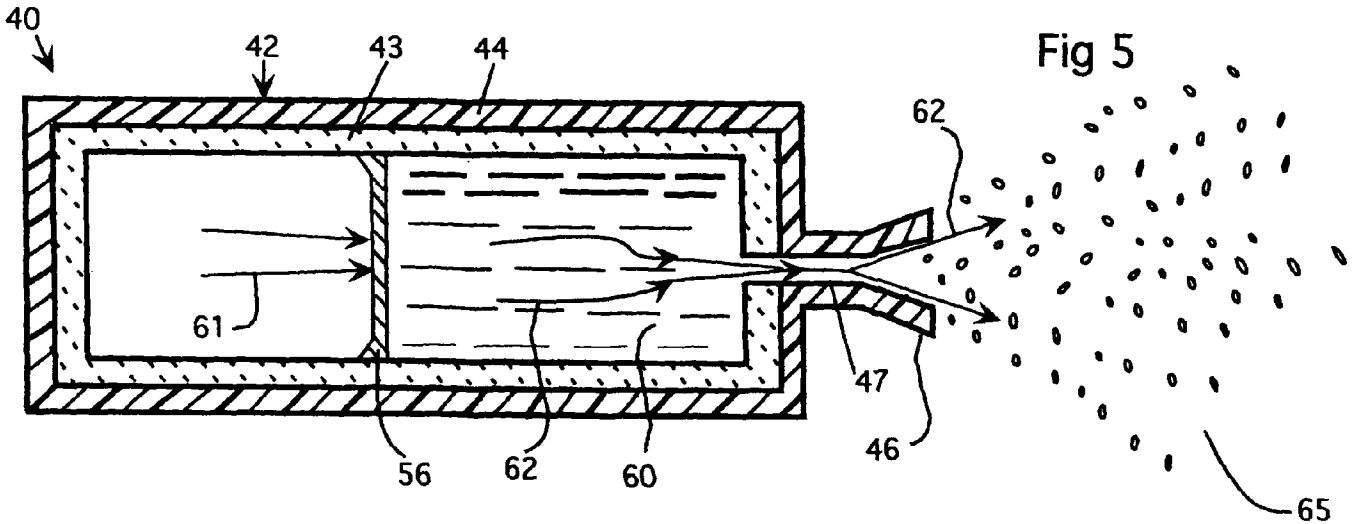
FIG. 5 is a view similar to FIG. 4, but showing droplets of molten being dispersed into the environment.

FIGS. 4 and 5 depict another melted metal dispersal warhead 40 which is constructed in accordance with the principles of the present invention and is a further embodiment thereof for dispersing a quantity of reactive metal in molten, droplet form into the environment of the warhead, this environment being, typically and as before stated, selected to be the natural atmosphere or a natural body of water. Warhead 40 is characterized by using pressurized gas to disperse the molten droplets.

Warhead 40 has a generally cylindrical container 42 constructed of any suitable ceramic insulating material 43 disposed within a casing 44. The casing is provided at one end with an atomizing or droplet dispersing nozzle 46 which is of any appropriate construction and communicates by a passage 47 with the container interior.

As seen in FIG. 4, warhead 40 is like warhead 10 in having before actuation, within container 42 and at the end thereof bearing nozzle 46, a quantity of solid reactive metal 50, in which is embedded thermite reaction heaters 52 which are ignited to melt the metal. However, warhead 40 has, at the end opposite the nozzle, any suitable gas generator indicated by numeral 54, and has a piston 56 disposed between the gas generator and the quantity of solid reactive metal.

When warhead 40 is actuated as shown in FIG. 5, heaters 52 are ignited, and after metal 50 is melted as indicated by numeral 60, gas generator 52 is activated so that pressurized gas therefrom acts on piston 54 as indicated by arrows 61 and urge's the piston toward nozzle 46 so that the molten metal is expelled, as indicated by arrows 62, from container 42 through communicating passage 47 and from the nozzle to form, in the environment of warhead 40, droplets 65 of the hot, molten reactive metal. These droplets react, forthwith and in accordance with the present invention, with a substance in the environment so that an explosive reaction occurs between the reactive metal and the fluid environment without initiation by a catalyst, pyrophoric material, or reactive material other than the reactive metal.

It is evident, from the foregoing description of various embodiments of the present invention, that all these embodiments carry out a process for causing an explosive reaction wherein a reactive metal is disposed in a container before placing the metal in a fluid environment selected for exothermic reaction with hot, molten droplets of the metal after the metal has been brought to at least its melting point by heat from at least one exothermic reaction applied to the reactive metal in the container, molten droplets of the reactive metal. then being dispersed into such environment to initiate the explosive reaction between the reactive metal and the fluid environment.

It is also evident that these ordnance device embodiments are adapted for disposition in an air environment or in an underwater environment so that, when the quantity of reactive metal contained in the device is dispersed therefrom in molten, droplet form for an energy releasing reaction with oxygen or water in such environment, the reaction is initiated solely by reaction of molten droplets of the reactive metal with the oxygen or water without the assistance of a catalyst, pyrophoric material, or additional oxidizable material.

Although the present invention has been herein shown and described in connection with what is conceived as the preferred embodiment, it is recognized that departures may be made therefrom within the scope of the invention which is not limited to the illustrative details disclosed.

What is claimed is:

1. An ordnance device, comprising:

a container;

a quantity of a reactive metal comprising a melting point and disposed in said container;

a heater contacting being embedded in, and being completely surrounded by said quantity of said reactive metal for heating said quantity of said reactive material to a temperature in a range of temperature, including said melting point, where the heater is substantially adjacent the quantity of the reactive material; and explosive material for dispersing said quantity of reactive metal at said temperature from the container in molten, droplet form, wherein said heater heats said quantity of reactive metal to a temperature below said melting point, wherein said explosive material is juxtaposed to said quantity of reactive metal for detonation to rupture said container, and said explosive material is selected so as to raise the temperature of said quantity of said reactive metal at least to said melting point when said explosive material is detonated.

2. The ordnance device of claim 1, wherein said quantity of said reactive metal is initially in a compressed, particulate form.

3. The ordnance device of claim 1, wherein said heater is a material mixed with said quantity of said reactive metal and utilizes a thermite reaction.

* * * * *